United States Patent [19]

Radvan et al.

[11] 4,263,344

[45] Apr. 21, 1981

[54] PAPER COATING METHODS

[75] Inventors: Bronislaw Radvan, Flackwell Heath; David J. Dobson, Wokingham, both of England

[73] Assignee: Wiggins Teape Limited, London, England

[21] Appl. No.: 786,382

[22] Filed: Apr. 11, 1977

Related U.S. Application Data

[63] Continuation of Ser. No. 604,935, Aug. 15, 1975, abandoned.

[30] Foreign Application Priority Data

Aug. 23, 1974 [GB] United Kingdom ..... 37124/74

[51] Int. Cl.[3] ..... B41M 5/22; B41M 5/16

[52] U.S. Cl. ..... 427/150; 282/27.5; 427/151; 427/180; 427/201; 427/356; 427/373; 427/391; 427/395; 427/397.7; 428/342; 428/537; 428/914

[58] Field of Search ..... 8/79, 138; 427/146, 427/150, 151, 180, 261, 201, 271, 348, 356, 358, 369, 373, 391, 395, 397.7; 428/310, 314, 411, 537, 913, 914, 409, 307, 327, 331, 340–342; 282/27.5

[56] References Cited

U.S. PATENT DOCUMENTS

| | | | |
|---|---|---|---|
| 1,948,568 | 2/1934 | Faber et al. | 8/138 X |
| 3,083,124 | 3/1963 | Rahmes | 428/306 X |
| 3,607,341 | 9/1971 | Goins et al. | 428/314 X |
| 3,884,506 | 5/1975 | Ozutsumi et al. | 282/27.5 |
| 3,906,123 | 9/1975 | Vincent et al. | 428/411 XR |
| 4,038,445 | 7/1977 | Robertson | 282/27.5 |

FOREIGN PATENT DOCUMENTS

| | | |
|---|---|---|
| 1039540 | 8/1966 | United Kingdom . |
| 1348390 | 3/1974 | United Kingdom . |

*Primary Examiner*—Bruce H. Hess

*Attorney, Agent, or Firm*—Burns, Doane, Swecker & Mathis

[57] ABSTRACT

A method of coating sheet material with a coating composition comprising particulate solid material suspended in a liquid carrier, wherein the coating composition is applied to the sheet material as a foam and subsequently dried, the air content of the foam being such that the viscosity of the coating composition is greater in its unfoamed state than in the foamed state in which the composition is applied.

19 Claims, No Drawings

PAPER COATING METHODS

This is a continuation, of application Ser. No. 604,935 filed Aug. 15, 1975 now abandoned.

This invention relates to a method for coating a web of sheet material, such as paper or board, with a coating composition comprising particulate solid material suspended in a liquid carrier.

Hitherto, it has been a common practice to apply an excess of such a coating composition to the web, and subsequently to remove the excess by means of a solid member such as a blade, thereby to meter the composition to a desired coatweight. In order that the suspension should have sufficient fluidity for coating by such means, its viscosity must not be too great. For suspensions of many materials, the viscosity preferably does not exceed 2,500 to 3,000 centipoise (Brookfield). In the case of a suspension exhibiting thixotropic properties, any tendency for the coating composition to exhibit an unworkably high viscosity may be overcome at the coating head by maintaining the suspension in a state of shear, but difficulties may still arise in other parts of the system where it is not always feasible to provide the necessary shear conditions. In practice therefore, viscosity requirements impose limitations on the solids content of such suspensions, whether or not they are thixotropic in character.

The particular solids content at which the viscosity becomes excessively high for satisfactory coating varies with the rheology of the material concerned and with the nature of the liquid carrier (which is normally water). For example, a clay having a platelet structure will generally coat at a higher solids content in aqueous suspension than a pigment such as titanium dioxide where the particulate structure is irregular. In the case of the acid clays used in the coating of pressure sensitive papers, the rheology of the clay has hitherto been found to impose an upper limit on the clay content of the coating suspension of about 45%.

The limitation on solids content imposed by viscosity requirements influences the liquid content of the suspension, and hence the drying capacity required to dry the coating after it has been applied to the sheet material. It will be evident that any means whereby an increase in the solids content of the coating suspension can be effected without at the same time causing an increase in the viscosity will reduce the water content required and thus minimize the drying load. This will in turn tend to reduce process costs and accelerate the manufacturing process.

It has now been discovered that the viscosity of a solids suspension can be reduced by foaming the suspension.

According to a first aspect of the invention, there is provided a method of coating sheet material with a coating composition comprising particulate solid material suspended in a liquid carrier, wherein the coating composition is applied to the sheet material as a foam and subsequently dried, the air content of the foam being such that the viscosity of the coating composition is greater in its unfoamed state than in the foamed stated in which the composition is applied.

According to a second aspect of the invention, there is provided sheet material which has been coated by a method according to the first aspect of the invention.

The present method may for example be used for applying art paper coating compositions, and coating compositions for producing color developer sheets for pressure sensitive copying systems, for example acidic clay or phenolic resin compositions.

The air content of the foam which will have the effect of lowering the viscosity of the coating composition varies somewhat with the nature and solids content of the coating composition.

For example, for a coating composition of art paper, the air content is preferably not more than 30%, although even in this range, the preferred air content varies widely depending on the constituents of the composition.

For an art paper composition or an acidic clay composition for a colour developer sheet of a pressure-sensitive copying system, foaming with a low air content initially lowers the viscosity of the composition, but increasing air content eventually causes a rise in viscosity, and an air content is reached at which the viscosity of the foamed composition is greater than that of the unfoamed composition (use of such a composition is not of course within the scope of the present invention).

For a phenolic resin composition for a colour developer sheet of a pressure-sensitive copying system, it has surprisingly been found that as the air content is increased, the viscosity continues to fall, rather than reaching a minimum value and then rising again. This was found to be so up to 57% air content. Possibly, although not definitely, a minimum viscosity is reached above this air content.

The present invention has so far been found to permit greater control and reproducibility of coating operations at high solids content than is achievable with an unfoamed coating composition. This is thought to be due to the fact that for a high viscosity composition, e.g. 3,000 cP a small unintentional change in water content of the composition (such as inevitably occurs sometimes in commercial production) results in a large change in viscosity, which can considerably affect the coatweight applied and the coating pattern achieved. At the lower viscosities achievable by the present method, however, a small change in water content has a much smaller effect on viscosity, and hence control of the coating operation is facilitated.

It has also been found that for art paper at least, a paper having a smoother surface may be obtained by use of the present method.

The invention will now be illustrated by the following examples:

EXAMPLE I

An aqueous dispersion of 64% solid material was prepared from the following components:

| | |
|---|---|
| Water | 65.0 parts |
| Dispersants (Calgon PT, as sold by Messrs. Albright and Wilson Ltd. and Dispex N40 as sold by Messrs. Allied Colloids Ltd.) | 0.89 parts |
| Ammonium Hydroxide (.88 solution) | 0.5 parts |
| Binder (Vinacryl 7172 as sold by Vinyl Products Ltd.) | 43.0 parts |
| China Clay (Dinkie A sold by English China Clays Ltd.) | 140.0 parts |
| Ground Calcium Carbonate | 15.0 parts |
| Foaming Agent (Empicol ESB 30 supplied by Albright & Wilson Ltd.) | 0.7 parts |

The above composition is of a kind commonly used in the production of art paper, apart from the foaming agent.

Preparation was effected by first dissolving the dispersants in the water in a first mixing tank and then dispersing the China Clay and calcium carbonate with vigorous stirring to form a slurry. The ammonium hydroxide and binder were then added and the slurry transferred to a second mixing tank where the foaming agent was added with slow stirring to produce a foamed aqueous suspension. Table I below shows the relationship between solids content, air content and viscosity for the suspension obtained.

TABLE I

| Solids Content % | Air Content % | Viscosity cP (Brookfield 100 rpm) Spindle 5, 25° C. |
|---|---|---|
| 64 | 0 | 2,600 |
| 64 | 3.5 | 1,700 |
| 64 | 4.0 | 1,900 |
| 64 | 10.0 | 2,000 |
| 64 | 16.0 | 2,400 |

It will be seen that the viscosity of each of the foamed suspensions was lower than that of the unfoamed suspension. The lowering of viscosity is most marked with an air content of about 3.5%.

After foaming, the mix was coated onto 49 g/m$^2$ base paper at a coat weight of about 10 g/m$^2$ both by conventional trailing blade and flexible blade coating methods on a pilot plant coater. The coater had a re-circulation loop applicator system consisting of a catch pan into which both fresh unfoamed suspension and excess suspension removed by the blade were fed. A mixture of the fresh and excess mix was pumped from the catch pan to the applicator system via a diffuser air addition system, a high shear disc mixer, a tube foaming unit and an air content measuring device. The system was closed to the atmosphere and had a minimum of "dead" flow zones, in order to maintain foam consistency as far as possible. Such a coater is shown in more detail in FIGS. 1 and 2 of the copending application for U.S. Patent in the name of George Douglas Robertson, Ser. No. 590,681, filed June 26, 1975 (now U.S. Pat. No. 4,038,445, issued July 26, 1977).

The coated paper was found to be free from cockle, and had good coating pick, surface smoothness and improved coating profile.

EXAMPLE II

An aqueous dispersion of 55% solids material was prepared and coated onto 49 g/m$^2$ base paper in the manner described in Example I, but with different components in the dispersion as follows:

| | |
|---|---|
| Water | 85 parts |
| Dispersants (as in Example I) | 0.89 parts |
| Ammonium Hydroxide (.88% solution) | 0.5 parts |
| Binder (Vinacryl 7171 sold by Vinyl Products Ltd.) | 15 parts |
| Binder (Vinacryl 4320 sold by Vinyl Products Ltd.) | 28 parts |
| China Clay (Dinkie A sold by English China Clays Ltd.) | 140 parts |
| Ground Calcium Carbonate | 15 parts |
| Foaming Agent (Empicol ESB 30 sold by Albright & Wilson Ltd.) | 0.35 parts |

The above composition is of a kind commonly used in the production of art paper, apart from the foaming agent.

Although the solids content was less than that of the compositions prepared in Example I, the binder system used had the effect of increasing the viscosity of the unfoamed suspension.

TABLE II

| Solids Content % | Air Content % | Viscosity cP Brookfield 100 rpm) Spindle 5, 25° C. |
|---|---|---|
| 55 | 0 | 2,600 |
| 55 | 4.8 | 2,000 |
| 55 | 12.5 | 1,700 |
| 55 | 16.0 | 1,600 |
| 55 | 27.0 | 1,600 |
| 55 | 31.0 | 1,700 |

It will be seen that the viscosity of the suspension was at a minimum in the region of 16% to 27% air content. The physical characteristics of the coated paper were found to be as satisfactory as was the case for the coated paper produced in Example I.

EXAMPLE III

This example relates to an aqueous suspension of an acidic reactive clay suitable for use as a colour developer coating for a pressure-sensitive copying paper. The nature and function of such paper is well known in the pressure-sensitive copying paper art and so will not be described further herein. An aqueous suspension at 47% solids content was prepared, from the following components:

| | |
|---|---|
| Water | 135 parts |
| Sodium Silicate | 17.5 parts |
| Ground Talc | 15.0 parts |
| China Clay (Dinkie A sold by English China Clays Ltd. | 20.0 parts |
| Acidic reactive Clay (Silton M-AB sold by Mizusawa Industrial Chemicals Ltd. of Osaka, Japan) | 96.0 parts |
| Binder (Vinacryl 7170 sold by Vinyl Products Ltd.) | 37.0 parts |
| Foaming Agent (Empicol ESB 30 sold by Albright & Wilson Ltd.) | 2.0 parts |

The sodium silicate, talc, China clay and reactive clay were first dispersed in the water over a period of one hour with vigorous stirring in a first mixing tank. The binder was then added and mixing continued for five minutes. The resulting slurry was then transferred to another mixing tank, and the foaming agent was then added under low shear conditions to produce a foamed aqueous suspension. The resultant foamed dispersion was thixotropic in character. Table III below shows the relationship between solids content, air content and viscosity. In view of the thixotropic nature of the foamed dispersion, the viscosity was measured in each case after shear thinning had occurred.

TABLE III

| Solids Content % | Air Content % | Viscosity cP Brookfield 100 rpm Spindle 5,25° C. |
|---|---|---|
| 47 | 0 | 385 |
| 47 | 11.3 | 310 |
| 47 | 12.8 | 265 |
| 47 | 17.4 | 390 |

TABLE III-continued

| Solids Content % | Air Content % | Viscosity cP Brookfield 100 rpm Spindle 5,25° C. |
|---|---|---|
| 47 | 21.9 | 480 |
| 47 | 28.8 | 585 |

It will be seen that the foamed suspension exhibited a lower viscosity than an unfoamed dispersion for an air content of the order of 12 to 13%.

However, at an air content of 17% and above, foaming resulted in an increase in viscosity, and hence is outside the scope of the present invention.

It has been found that a foamed dispersion having an air content of about 12 or 13% can be handled satisfactorily in a coating system under non-shear conditions.

The foamed mix was coated onto 49 g/m$^2$ paper base in the manner described above with reference to Example I. The results obtained showed that the change in the character of coating mix and the addition of a foaming agent did not affect the functional properties of the coated paper thus produced.

Empicol ESB30 is a surface active agent of the lauryl ethylene oxide sulphate type. However, for forming a foamed aqueous suspension of reactant clay, any other surfactant may be used which does not inhibit the reactivity of the clay or cause the components of the suspension to flocculate. Examples of such other surfactants are alkyl phenyl ether, alkyl phenyl ethylene oxide, alkyl ether sulphate, alkyl benzene sulphonate and alkyl sulphate.

EXAMPLE IV

An aqueous dispersion of an approximately 44% solids material was prepared in two stages. A reactive resin slurry was first prepared from the following components using a Silverson mixer (a high shear rotating shaft mixer):

| | |
|---|---|
| Dispersant (25% solution of the sodium salt of a condensed sulphonated organic acid) | 1 part |
| Water | 7 parts |
| Phenolic resin | 11 parts |

The slurry was ground in a torrance 30S attritor for 2½ hours and used in the following coating formulation.

| | |
|---|---|
| Water | 40 parts |
| Resin slurry (as prepared above) | 18 parts |
| 10% Starch gum | 45 parts |
| 50% solids carboxylated styrene butadiene | 8 parts |
| Coating clay | 50 parts |
| Calcium carbonate | 4 parts |

The components were added to a mixing tank with virorous stirring and, with addition of various amounts of polyvinyl alcohol as a foaming agent. (The polyvinyl alcohol was that solid as Moviol 4/88 by Farbwerke Hoechst AG). Air was introduced into the mix as a consequence of vortex production by the mixer and of the presence of the foaming agent.

Table IV below shows the relationship between the solids content, polyvinyl alcohol content, air content and viscosity for the suspension. It will be seen that for this formulation the viscosity continually decreased as the air content increased, i.e. no "minimum" viscosity was observed.

TABLE IV

| Polyvinyl Alcohol % by Weight | Solids Content % | Air Content % | Viscosity cp Brookfield 100 rpm Spindle 5,25° C. |
|---|---|---|---|
| 0% | 37.4 | 0 | 1,250 |
| 0.1% | 37.4 | 2 | 1,130 |
| 0.2% | 37.4 | 24 | 700 |
| 1% | 37.4 | 57 | 420 |

As in Example III, the viscosity was measured after shear thinning had occurred.

Coating compositions with the air contents given in Table IV were coated on to a 49 g/m$^2$ base paper using a laboratory blade coater. The coated paper was found to have an acceptable functional properties when used in a pressure-sensitive copying system as a paper which had been coated with a non-foamed composition.

EXAMPLE V

This involved further work on the formulation detailed in Example IV with a polyvinyl alcohol content of 1%. The object was to investigate the results obtained on scaling up the process.

The components were added to a tank in the order indicated in Example IV, under vigorous stirring by rotary mixing blades. Air was then forced under high pressure through a perforated pipe located near the mixing blades at the base of the tank. Shearing was maintained during this process. Table Va shows the observed relationship between solids content, air content and viscosity. As in Examples III and IV, the viscosity was measured after shear thinning had occurred.

TABLE Va

| Solids Content % | Air Content % | Viscosity cP Brookfield 100 rpm Spindle 5, 25° C. |
|---|---|---|
| 44 | 0 | 1968 |
| 44 | 6 | 1376 |
| 44 | 10.4 | 1216 |

The mix was transferred to the mix circulation and foaming unit of the pilot plant coater described in Example I. Further air was added by circulating the mix in the system. Table Vb shows the observed relationship between solids content, air content and viscosity. Once again, viscosity measurement was carried out after shear thinning had occurred.

TABLE Vb

| Solids Content % | Air Content % | Viscosity cP Brookfield 100 rpm Spindle 5, 25° C. |
|---|---|---|
| 44 | 10.4 | 1216 |
| 44 | 12.5 | 1024 |
| 44 | 24 | 980 |
| 44 | 29 | 948 |

The 29% air content formulation was then coated by means of a coating apparatus as shown in FIGS. 1 and 2 of the aforesaid copending application Ser. No. 590,681.

The properties of the coated paper were satisfactory.

EXAMPLE VI

An aqueous dispersion was prepared using the following material:

| | |
|---|---|
| Water | |
| Sodium Hydroxide | 3.3 parts |
| Carboxymethylcellulose (supplied by Svenska Cellulosa Sundsvall Sweden) | 2.3 parts |
| Acidic Reactive clay (sold as Silton M-AB by Mizusawa Industrial Chemicals Ltd. of Osako, Japan) | 79 parts |
| China Clay (Dinkie A sold by English China Clays Ltd.) | 16.5 parts |
| Talc | 12.5 parts |
| Styrenebutadiene Latex (Dow 620 sold by Dow Chemical Co.) | 24 parts |

The components were mixed in the order shown, using a laboratory rotating shaft mixer. The quantity of water used was that required to give a 50% solids composition. A small percentage of polyvinyl alcohol was added as a foaming agent. Air became entrained in the mix as a consequence of vortex production by the mixer and the presence of the foaming agent. Table VI below shows the observed relationship between polyvinylalcohol content, solids content, air content and viscosity. Viscosity measurements were made after shear thinning had occurred.

TABLE VI

| Polyvinyl Alcohol % by Weight | Solids Content % | Air Content % | Viscosity cP Brookfield 100 rpm Spindle 5,25° C. |
|---|---|---|---|
| 0 | 50 | 0 | 2800 |
| 1 | 50 | 9.3 | 1860 |
| 2 | 50 | 10.7 | 2078 |

EXAMPLE VIII

This involved further work on the formulation set out in Example VI, with a polyvinylalcohol content of 1% but a solids content of 44%. The object was to investigate the results obtained on scaling up the process.

The components were added to a tank and sheared by means of rotary blades. Air was forced under high pressure through a perforated pipe at the base of the tank during mixing as in Example V.

The coating mix was transferred to the mix circulation and foaming unit of the pilot plant coater described in Example V. Air was added by circulating the mix in the system. Table VIII below shows the observed relationship between solids content, air content and viscosity. It proved difficult to obtain a foam of low air content, i.e. less than 10%. Viscosity measurements were made after shear thinning had occurred.

TABLE VIII

| Solids Content % | Air Content % | Viscosity cP Brookfield 100 rpm Spindle 5, 25° C. |
|---|---|---|
| 44 | 0 | 2100 |
| 44 | 10 | 1480 |

The 10% air content mix was then coated at a coatweight of about 10 g/m$^2$, using a coating apparatus as shown in FIGS. 1 and 2 of our copending British patent application No. 29729/74. The properties of the coated paper were very similar when tested in a pressure-sensitive copying system to those obtained with a paper which had been coated with a non-foamed coating composition.

Unless otherwise indicated, all references to "% solids" indicates percentage by weight of the solid material and all references to "air content" indicates the percentage of air by volume.

What we claim is:

1. In the process of producing coated sheet material products which comprises using a sheet material coating composition of particulate solid material suspended in a liquid carrier, controlling the solids content of the coating composition to achieve a viscosity which provides satisfactory fluidity for coating, and drying the coating composition to deposit a particulate solid material coating on said sheet material, the improvement which comprises:

(a) incorporating a minor amount of foaming agent in the sheet material coating composition, foaming the composition, and carefully controlling the air content of the foam such that the viscosity of the coating composition is greater in its unfoamed state than in the foamed state in which the foam is applied, thus (i) permitting greater control and reproducibility of the coating process than is achievable with a similar composition which is unfoamed, and (ii) minimizing the drying load at step (c), infra;

(b) applying the foamed composition of step (a) to a surface of the sheet material;

(c) drying the sheet material to obtain a resulting coated sheet having a coating of predetermined solids content.

2. The process of claim 1 wherein the coating composition is an art paper coating composition.

3. The process of claim 1 wherein the coating composition is an acidic clay colour developer composition for pressure-sensitive copying paper.

4. The process of claim 1 wherein the coating composition is a phenolic resin colour developer composition for pressure-sensitive copying paper.

5. The process of claim 1 wherein the sheet material is sheet paper material.

6. The process of claim 5 wherein the coating composition is a coating composition suitable for art paper.

7. The process of claim 5 wherein the coating composition is a coating composition suitable for use as a colour developer coating for pressure-sensitive copying paper.

8. The process of claim 1 wherein an excess of the foamed composition is applied to a surface of the sheet material; the excess is removed from the said surface to obtain a desired coatweight; and the sheet material dried to obtain the coated sheet material product.

9. Sheet material which has been coated by a process as claimed in claim 1.

10. In the method of coating paper material with particulate solids deposited from a coating composition comprising particulate solid material suspended in an aqueous system containing binder, which comprises the steps of (a) forming the coating composition so that it exhibits a desired viscosity which allows a substantially uniform, smooth coatweight of said particulate solids to be obtained on a surface of the paper material;

(b) applying said coating composition in excess to a surface of the paper material;

(c) removing the excess of such coating composition from said surface of the paper material to provide said desired coatweight; and then (d) drying the coated paper material to provide the coated paper product; the improvement which comprises:

incorporating a minor amount of foaming agent in the coating composition, foaming the composition, and carefully controlling the air content of the foam such that the viscosity of the coating composition is greater in its unfoamed state than in the foamed state as applied in step (b), thus (i) permitting greater control and reproducibility of the coating process than is achievable with a similar composition which is unfoamed, and (ii) minimizing the drying load of step (d) by reducing the water content of the coating composition of step (a) relative to that which would otherwise provide said desired viscosity.

11. In the method as defined in claim 10 wherein the particulate solids of said coating composition of step (a) comprises China clay and said foaming agent is a surface active agent.

12. In the method as defined in claim 10 wherein the particulate solids of said coating composition of step (a) comprises acidic reactive clay and said foaming agent is a surface active agent unreactive with said clay.

13. In the method as defined in claim 10 wherein said coating composition of step (a) contains reactive phenolic resin and coating clay, and said foaming agent is polyvinyl alcohol.

14. The method as defined in claim 10 wherein the particulate solids of the coating composition of step (a) comprises acidic reactive clay and said foaming agent is polyvinyl alcohol.

15. The method as defined in claim 10 wherein the coating composition of step (a) consists essentially of:

water: about 65 parts
binder: about 43 parts
china clay: about 140 parts
ground calcium carbonate: about 15 parts
foaming agent: about 0.7 part, said air content of the foamed coating composition is about 3.5% and said desired coatweight is about 10 $g/m^2$.

16. The method as defined in claim 10 wherein the coating composition of step (a) consists essentially of:

water: about 85 parts
binder: about 43 parts
China clay: about 140 parts
ground calcium carbonate: about 15 parts
foaming agent: about 0.35 part, and said air content of the foamed coating composition is about 16% to about 27%.

17. The method as defined in claim 10 wherein the coating composition of step (a) consists essentially of:

water: about 135 parts
sodium silicate: about 17.5 parts
ground talc: about 15 parts
China clay: about 20 parts
acidic reactive clay: about 96 parts
binder: about 37 parts
foaming agent: about 2 parts, and the air content of the foamed coating composition is about 12–13%.

18. The method as defined in claim 10 wherein the coating composition of step (a) consists essentially of:

water: about 40 parts
phenolic resin slurry (7/11 of water/phenolic resin): about 18 parts
10% starch gum: about 45 parts
50% solids carboxylated styrene butadiene: about 8 parts
coating clay: about 50 parts
calcium carbonate: about 4 parts
polyvinyl alcohol: about 1%.

19. The method as defined in claim 10 wherein the coating composition of step (a) consists essentially of:

sodium hydroxide: about 3.3 part
carboxymethylcellulose: about 2.3 part
acidic reactive clay: about 79 parts
China clay: about 16.5 part
talc: about 12.5 part
styrenebutadiene latex: about 24 parts
water in amount sufficient to give a coating of about 44% solids
polyvinyl alcohol: about 1%, and the air content of the foamed coating composition is about 10%.

* * * * *